United States Patent [19]

Silverman et al.

[11] Patent Number: 4,524,557

[45] Date of Patent: Jun. 25, 1985

[54] SHEET PROCESSING APPARATUS

[75] Inventors: Harold Silverman, Wilton; James S. Ramsey, Shelton; Robert Irvine, Riverside, all of Conn.

[73] Assignee: Pitney Bowes Inc., Stamford, Conn.

[21] Appl. No.: 569,413

[22] Filed: Jan. 9, 1984

[51] Int. Cl.[3] ..... B65B 11/48

[52] U.S. Cl. ..... 53/55; 53/201; 53/266 A; 493/234

[58] Field of Search ..... 53/55, 201, 206, 266 A, 53/120, 117, 77; 493/30, 224, 234, 235, 236, 231, 60, 359, 360, 356

[56] References Cited

U.S. PATENT DOCUMENTS

| | | | |
|---|---|---|---|
| 3,258,261 | 6/1966 | Vath et al. | 493/30 |
| 3,611,884 | 10/1971 | Hottendorf | 493/60 X |
| 4,161,091 | 7/1979 | Hartnig | 53/266 A X |
| 4,464,878 | 8/1984 | Golicz et al. | 53/266 A X |

*Primary Examiner*—James F. Coan

*Attorney, Agent, or Firm*—Lawrence E. Sklar; William D. Soltow, Jr.; Albert W. Scribner

[57] ABSTRACT

Sheet processing apparatus including a bursting machine for feeding and bursting a continuous web along perforation lines, a folding machine for folding the sheets from the bursting machine and an inserting machine for inserting the folded sheets into an envelope, and [i] a device for removably connecting the bursting machine to the folding machine, [ii] a device for removably connecting the folding machine to the inserting machine and [iii] a device for removably connecting the bursting machine directly to the inserting machine in the absence of the folding machine; controls operatively interconnected between the inserting machine and the folding machine for controlling the sequential operation of the folding machine with the cyclical operation of the inserting machine so that the folding machine operates on demand from the inserting machine; controls operatively interconnected between the folding machine and the bursting machine for controlling the sequential operation of the bursting machine in timed relationship with the cyclical operation of the folding machine so that the bursting machine operates on demand from the folding machine; controls operatively interconnected between the bursting machine and the inserting machine for controlling the operation of the bursting machine by the inserting machine in the absence of the folding machine; and controls in the bursting machine for controlling the operation of the bursting machine in the absence of both the folding machine and the inserting machine.

5 Claims, 4 Drawing Figures

SHEET PROCESSING APPARATUS

BACKGROUND OF THE INVENTION

The instant invention relates to web feeding apparatus and more particularly to a bursting component, a folding component and an inserting component which can be utilized in a variety of combinations.

Typically, when reading material is to be mailed to a large plurality of people, an inserting machine is utilized for inserting the reading material into an envelope. In those cases where it is necessary to fold the reading material before insertion into the envelope, a folding machine is coupled to the inserting machine and a system is created whereby the reading material is first folded and then inserted into the envelope. With the advent of computers and fan folded, perforated paper in web form, there developed a need to burst the web into discreet sheets before folding and inserting, and thus a bursting machine was added to the folding and inserting machines to create a three component system to burst, fold and insert discreet sheets that had been separated from a web.

Use of a bursting machine alone to separate web material into discreet sheets is clearly not new, and the use of a bursting machine in-line with a folding machine and an inserting machine is likewise not new. However, none of the prior art systems possesses the flexibility to enable (a) the burster to be used alone, (b) the burster to be used only with the folder, (c) the burster to be used only with the inserter, and (d) the burster to be used in line with the folder and the inserter. The instant invention therefore overcomes this shortcoming in the prior art by providing a sheet processing apparatus having the hereinabove described capability.

SUMMARY OF THE INVENTION

Accordingly, the instant invention provides sheet processing apparatus for bursting discreet sheets from a continuous web of paper having equally spaced perforation lines thereacross, for folding the discreet sheets and for inserting the discreet sheets into envelopes. The apparatus includes (a) a bursting machine having means for feeding a continuous web of paper and means for bursting discreet sheets from said continuous web across the perforation lines, (b) a folding machine having means for receiving said discreet sheets from said bursting machine and means for folding said sheets, (c) an inserting machine having means for receiving said folded sheets from said folding machine, means for inserting said folded sheets into envelopes at an inserting station, and means for feeding said envelopes to said inserting station, (d) [i] means for removably connecting said bursting machine to said folding machine, [ii] means for removably connecting said folding machine to said inserting machine, and [iii] means for removably connecting said bursting machine directly to said inserting machine in the absence of said folding machine, (e) control means operatively interconnected between said inserting machine and said folding machine for controlling the sequential operation of said folding machine with the cyclical operation of said inserting machine so that said folding machine operates on demand from said inserting machine, (f) control means operatively interconnected between said folding machine and said bursting machine for controlling the sequential operation of said bursting machine in timed relationship with the cyclical operation of said folding machine so that said bursting machine operates on demand from said folding machine, (g) control means operatively interconnected between said bursting machine and said inserting machine for controlling the operation of the bursting machine by the inserting machine in the absence of the folding machine, and (h) control means in the bursting machine for controlling the operation of the bursting machine in the absence of both the folding machine and the inserting machine.

DETAILED DESCRIPTION

Figure 1:
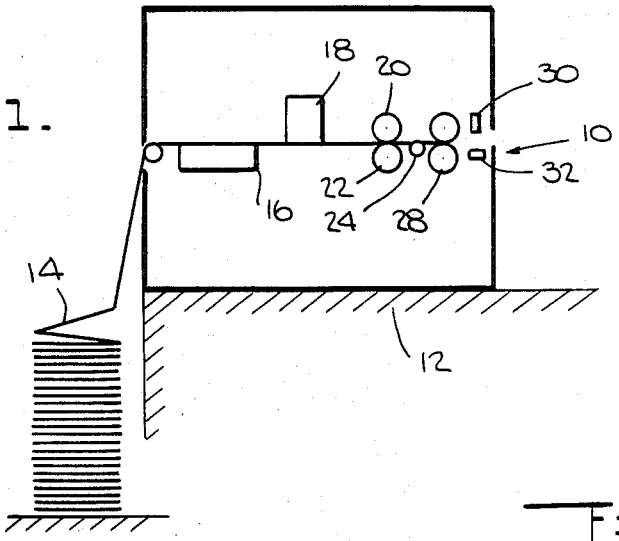
FIG. 1 is a schematic, side elevational view of bursting apparatus employed in the instant invention.

In describing the preferred embodiment of the instant invention, reference is made to the drawings wherein there is seen in FIG. 1 a table-top bursting machine 10 standing on a table top 12 for slitting and bursting the fan folded, continuous web of perforated paper 14 into discreet sheets. The web 14 includes perforation lines (not shown) equally spaced and apertures (not shown) on either side to facilitate guiding of the web 14 by the tractor guide 16, which guides the web 14 first to the slitter 18 which removes the side portions of the web 14 containing the apertures and then to the input rollers 20 and 22. Situated downstream of the input rollers 20 and 22 is a bursting cone 24, and downstream of the bursting cone 24 are a pair of output rollers 26 and 28, which together with the input rollers 20 and 22 and the bursting cone 24 burst the web 14 into discreet sheets. The bursting machine 10 includes its own motor (not shown), and the control of the feeding of the web 14 is through the input rollers 20 and 22 which are stopped when a predetermined count is reached, thereby causing the web to be burst over the bursting cone 24 due to the tension generated by the output rollers 26 and 28 pulling against the stationary input rollers 20 and 22. Feeding of the web 14 is resumed when the trailing edge of the separated, discreet sheet passes between the photocell 30 and the sensor 32. In the format seen in FIG. 1, the table-top bursting machine 10 functions by itself to slit and burst the fan folded web of perforated paper 14. As explained hereinbelow, the table-top bursting machine 10 includes the capability of being combined with other components to form an in-line system for treating the discreet sheets emanating from the bursting machine 10.

Figure 2:
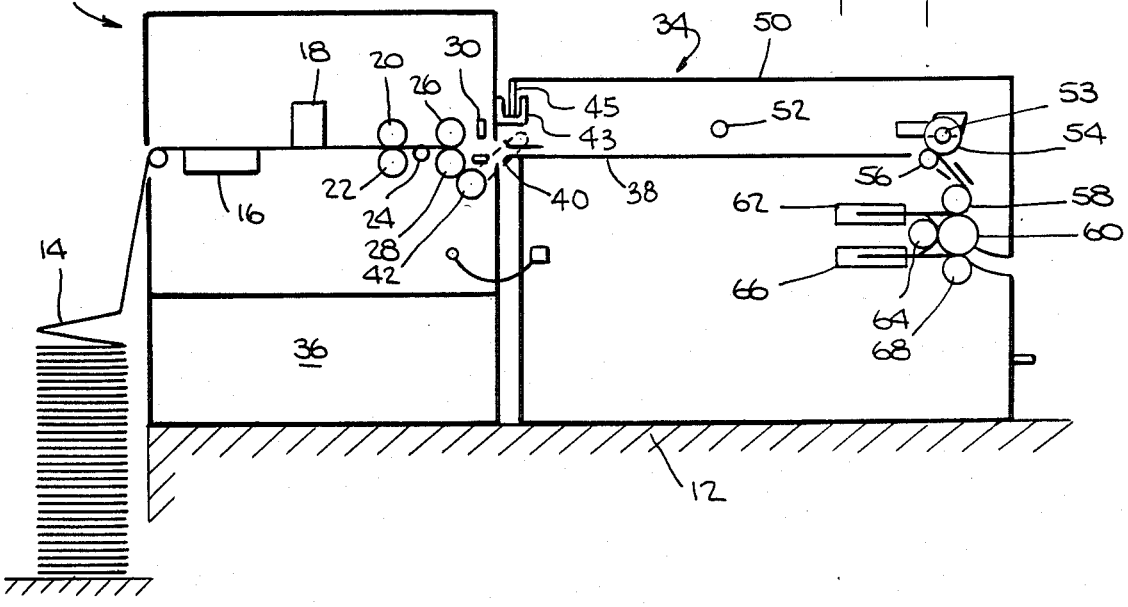
FIG. 2 is the same as FIG. 1 and additionally shows folding apparatus employed in the instant invention.
Figure 4:
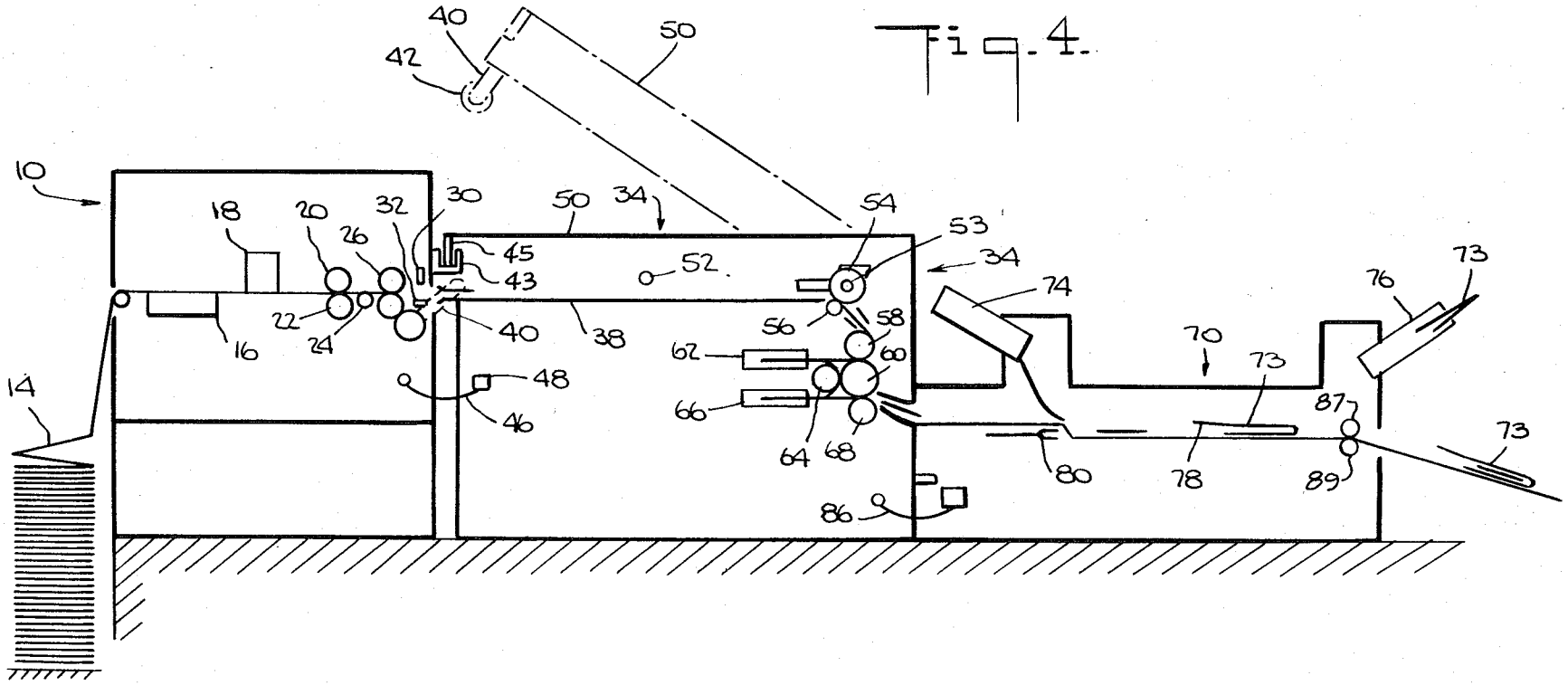
FIG. 4 is the same as FIG. 1 and additionally shows folding and inserting apparatus employed in the instant invention.

There is seen in FIG. 2 a second format in which the bursting machine 10 may be used, and it includes a folding machine 34. In this system, it is necessary to employ a supporting base 36 beneath the bursting machine 10 in order to raise the bursting machine 10 to a sufficient height so that the discreet sheets exiting the bursting machine 10 are at the proper level for being fed onto the conveyor belt 38 of the folding machine 34. The conveyor belt 38 is driven by a belt 40 which in turn is geared to a driven roller 42 which is driven by the output roller 24. The folding machine 34 is latched to the bursting machine 10 by means of a groove 43 projecting from the bursting machine 10 which engages a tongue 45 projecting from the cover 50 of the folding machine 34. The folding machine 34 includes its own motor for its folding components (described in detail hereinbelow) and is electrically connected to the bursting machine 10 by means of a plug 46 emanating from the bursting machine 10 and engaging a receptacle 48 in the folding machine 34. The driven roller 42 is rotatably supported by the cover 50 of the folding machine 34 and can be disengaged from the input roller 28 of the bursting machine 10 by simply moving a knob 52 to the right which then permits the cover 50 to be raised by pivoting about a shaft 53, as seen in FIG. 4, in order to enable the operator to clear any paper jams that may occur in the folding machine 34.

The discreet sheets, after having been deposited on the conveyor belt 38 from the bursting machine 10, are carried by the conveyor belt 38 through a feed roller 54 fixed to the shaft 53 and a stone 56, then through a pair of feed rollers 58 and 60 and into a buckle chute 62, where the discreet sheet receives its first fold. The once folded discreet sheet is then fed through the feed roller 60 and another feed roller 64 into a second buckle chute 66 where it is folded a second time. The twice folded discreet sheet finally emerges through the feed roller 60 and another feed roller 68 and exits the folding machine 34.

The folding machine 34 runs continuously, and the web 14 is forwarded by the input rollers 20 and 22 in the bursting machine 10 when the lead edge of the preceding discreet sheet enters the nip of the feeding rollers 58 and 60 so that the conveyor belt 38 is clear and can receive the discreet sheeting exiting the bursting machine 10. The input rollers 20 and 22 stop in the same manner as described with reference to the format seen in FIG. 1, i.e., the input rollers 20 and 22 are stopped when a predetermined count is reached, thereby causing the web 14 to be burst.

Figure 3:
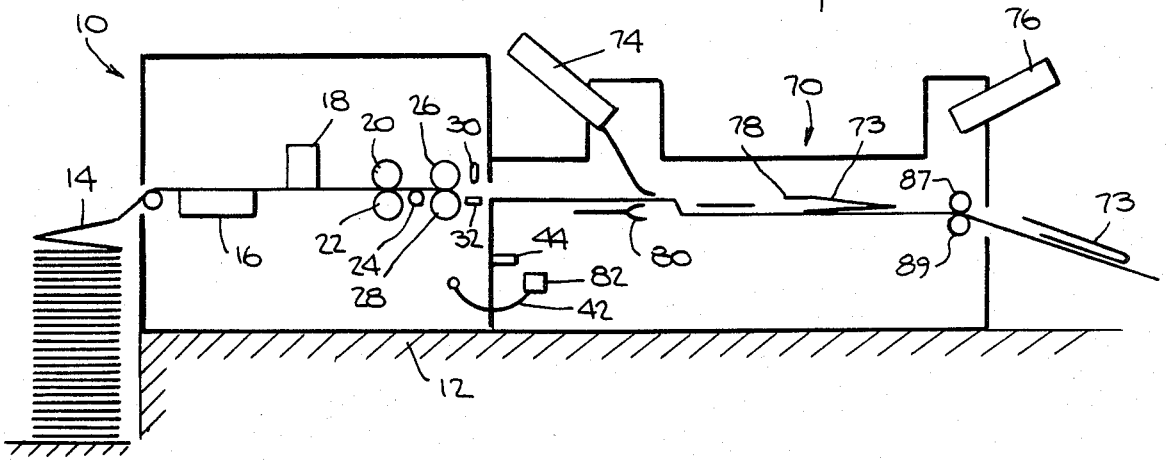
FIG. 3 is the same as FIG. 1 and additionally shows inserting apparatus employed in the instant invention.

There is seen in FIG. 3 a third format in which the bursting machine 10 may be used, and it includes an inserting machine 70, which includes a platform 72 having a longitudinal slot (not seen) therein. Material to be inserted is received from either the bursting machine 10 and/or a feeding chute 74 and is deposited on the platform 72. Envelopes 73 into which the material is inserted are deposited onto the downstream portion of the platform 72 from an envelope feed chute 76. The glued portion of the envelope flap 78 faces downwardly and the material being inserted is pushed into the envelope 73 by means of a reciprocating pusher 80 which moves upwardly into the longitudinal slot in the platform 72 when material is to be inserted and on its return to home position retracts below the platform 72. The filled envelope 73 is carried out of the inserting machine 70 by means of a pair of feed rollers 87 and 89. In the format shown in FIG. 3, it is possible to insert two documents into the envelope 73, or material received from just the bursting machine 10 or material received from just the feeding chute 74. The inserting machine 70 includes its own motor and is electrically connected to the bursting machine 10 by means of the plug 46 emanating from the bursting machine 10 and engaging a receptacle 82 in the inserting machine 70. The bursting machine 10 is latched to the inserting machine 70 by means of the pin 44 projecting from the bursting machine 10 which engages a receptacle (not shown) in the inserting machine 70.

In operation, the web 14 is forwarded by the input rollers 20 and 22 in the bursting machine 10 in the same manner as described hereinabove with reference to the formats seen in FIGS. 1 and 2, but the starting of the input rollers 20 and 22 is initiated by the inserting machine 70. The stopping of the input rollers 20 and 22 is the same as described in reference to the format seen in FIG. 1.

There is seen in FIG. 4 a fourth format in which the bursting machine 10 may be used, and it includes the folding machine 34 and the inserting machine 70. As was the case with the format seen in FIG. 2, the bursting machine 10 rests on a supporting base 36, and is latched to the folding machine 34 in the same fashion as explained with reference to the format seen in FIG. 2, and the folding machine 34 is latched to the inserting machine 70 by means of a pin 84 projecting from the folding machine 34 which engages a receptacle (not shown) in the inserting machine 70. The bursting machine 10 is electrically connected to the folding machine 34 as described with reference to the format seen in FIG. 2 and the inserting machine 70 is electrically connected to the folding machine 34 by means of a plug 86 emanating from the folding machine 34 and engaging a receptacle 88 in the inserting machine 70.

In the operation of the format seen in FIG. 4, the folding machine feed roller 54 feeds on demand from the inserting machine 70, and the bursting machine 10 feeds on demand from the folding machine 34 as described with reference to the format seen in FIG. 2.

From the foregoing, it can be seen that a stand-alone burster can be used by itself, or in-line with a folder, or in-line with an inserter, or in-line with a folder and an inserter, thereby providing maximum flexibility.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. Sheet processing apparatus for bursting discreet sheets from a continuous web of paper having equally spaced perforation lines thereacross, folding the discreet sheets and inserting the sheets into envelopes, said apparatus comprising:

A. a bursting machine having means for feeding a continuous web of paper and means for bursting discreet sheets from said continuous web across the perforation lines;

B. a folding machine having means for receiving said discreet sheets from said bursting machine and for folding said sheets;

C. an inserting machine having means for receiving said folded sheets from said folding machine, means for inserting said folded sheets into envelopes at an inserting station, and means for feeding said envelopes to said inserting station;

D. (i) means for removably connecting said bursting machine to said folding machine, (ii) means for removably connecting said folding machine to said inserting machine and (iii) means for removably connecting said bursting machine directly to said inserting machine in the absence of said folding machine;

E. control means operatively interconnected between said inserting machine and said folding machine for controlling the sequential operation of said folding machine with the cyclical operation of said inserting machine so that said folding machine operates on demand from said inserting machine;

F. control means operatively interconnected between said folding machine and said bursting machine for controlling the sequential operation of said bursting machine in timed relationship with the cyclical operation of said folding machine so that said bursting machine operates on demand from said folding machine;

G. control means operatively interconnected between said bursting machine and said inserting machine for controlling the operation of said bursting machine by said inserting machine in the absence of said folding machine; and H. control means in the bursting machine for controlling the operation of said bursting machine in the absence of both the folding machine and the inserting machine.

2. The sheet processing apparatus of claim 1, wherein there is a gap between the bursting machine and the folding machine, and the folding machine is latched to the bursting machine by means of a groove projecting from the bursting machine and engaging a tongue projecting from the cover of the folding machine.

3. The sheet processing apparatus of claim 1, wherein the folding machine receiving means comprises a conveyor belt.

4. The sheet processing apparatus of claim 2, wherein the folding machine folding means comprises a plurality of rollers and at least one buckle chute.

5. The sheet processing apparatus of claim 2, wherein the bursting machine bursting means comprises a pair of input rollers, a pair of output rollers, and means to stop said input rollers when it is desired to burst said web.

* * * * *